United States Patent [19]

Haller et al.

[11] 4,181,445

[45] Jan. 1, 1980

[54] DEVICE FOR SELECTING A LINE TO BE PRINTED IN A PRINTER

[75] Inventors: Karl-Heinz Haller, Villingen-Schwenningen; Helmut Muller, St. Georgen, both of Fed. Rep. of Germany

[73] Assignee: Kienzle Apparate GmbH, Villingen, Fed. Rep. of Germany

[21] Appl. No.: 857,884

[22] Filed: Dec. 6, 1977

[30] Foreign Application Priority Data

Dec. 15, 1976 [DE] Fed. Rep. of Germany ..... 2656785

[51] Int. Cl.[2] ..... B41J 11/64; B41J 13/28; B41J 29/42

[52] U.S. Cl. ..... 400/632.1; 271/255; 400/707.2; 400/670.2; 400/708

[58] Field of Search ..... 271/253, 254, 255, 245; 400/632, 632.1, 707.3, 707.4, 670, 670.1-670.3, 707.0, 707.1, 707.2, 547, 581, 582, 622, 703, 708, 708.1

[56] References Cited

U.S. PATENT DOCUMENTS

| | | | |
|---|---|---|---|
| 1,326,346 | 12/1919 | Hsieh et al. | 400/707.4 |
| 1,594,780 | 8/1926 | Kupetz | 400/632.1 |
| 2,026,020 | 12/1935 | Christian | 400/632 |
| 2,607,465 | 8/1952 | Gherin | 400/707.3 |
| 2,662,629 | 12/1953 | Moshier et al. | 400/707.4 |
| 2,689,033 | 9/1954 | Grenier | 400/708.1 |
| 3,768,405 | 10/1973 | Grey | 400/622 |

*Primary Examiner*—William Pieprz
*Attorney, Agent, or Firm*—Toren, McGeady and Stanger

[57] ABSTRACT

In a printer where a card or record carrier is inserted for printing on one of a plurality of lines, a device is provided for determining the line to be printed. The device consists of a setting assembly and a stop and rest part. The setting assembly includes a card guide element surrounding and spaced radially outwardly from a setting shaft. The stop and rest part is positioned on the setting shaft and is radially adjusted by a spring against the internal surface in the guide element. The guide element has sensible markings for indicating the line selected to be printed.

13 Claims, 4 Drawing Figures

DEVICE FOR SELECTING A LINE TO BE PRINTED IN A PRINTER

SUMMARY OF THE INVENTION

The present invention relates to a device for determining a line to be printed on cards in a printer in which the cards can be inserted by an adjustable amount, and, more particularly, it concerns a movable card stop adjustable via setting means for predetermined spacings so that a range of at least 16 lines can be printed in columns.

Printers of this kind are used in connection with quantity counters when a receipt of the amount delivered is provided apart from an indication of the amount. Devices of this kind are mainly counters having indicating rollers in combination with a printing device which can be set by the revolutions of a drive shaft in proportion to the quantity delivered or any other measured value. Such devices may be used particularly in connection with liquid counters in mineral oil sales plants, pipe line networks and in tank trucks, but also in selling liquid food and the like. In view of its many applications, it is a basic requirement that the device be a compact unit for installation in confined spaces. For this reason and also for better manipulation it has proved advantageous with known devices to be able to insert receipt cards or the like horizontally. However, certain problems arise from the length of the cards and, accordingly from the necessary distance through which the cards must be inserted to be printed.

In a known device, the guide parts for the record carrier or card consist of a carrier table extending linearly behind the printing station in the input direction of the carrier. The device for adjusting the line to be printed, that is, the distance through which the record carrier may be moved consists of two pin wheels arranged at such a distance from the input slot to correspond to the entire distance through which the record carrier may be moved. An endless perforated tape is placed around the pin wheels so that it is guided and transported by the pin wheels. On the outside of the perforated tape, turned towards the card input slot, there is a stop which is adjustable by setting the perforated tape via the pin wheels for determining the distance through which the card may be inserted.

This known device for guiding a record carrier having at least 16 lines, a number corresponding to half a month, has shown to be disadvantageous, since the guiding parts for the record carrier project far above the other parts of the apparatus. A special housing shape is required to include the part needed for guiding the record carrier. Under the circumstances it is also necessary to arrange the printing station almost immediately behind the input slot to gain sufficient space for the input motion of the record carrier. When, however, the printing station is arranged immediately behind the input slot there is a considerable danger that manipulations can be made from outside.

For the above reasons devices of this kind are provided with guiding means for the record carrier arranged in the vertical direction wherever such an arrangement is possible. Such devices have become generally known through the so-called check clocks, where a time is printed on a certain day defined by a line with the card being moved against a stop which is adjusted daily and releases the printing process. A device of this kind in which the line to be printed adjusts itself and can additionally be adjusted by manual operation to take into consideration varying numbers of days, has been described in German Auslegeschrift No. 1 107 977. A stop plate for limiting the input movement of the card is moved linearly by means of toothed bars for automatically limiting the input movement of the record carrier and also for setting a corresponding line to take care of any irregularities in the number of days to be considered such as in the second half of the month. Besides the space required for the insertion of the card so that it rests on the stop plate mounted at a toothed bar, additional space is required for the toothed bar to be moved in the same direction and for its support in corresponding guide bars. Such linear movement of the card to be printed is, therefore, due to the required space, not suited to a compact design.

It is a primary object of the present invention to provide a simple and compact device for setting the input motion of a record carrier on which a number of lines are to be printed, within a large and adaptable range. Another object is to afford a correspondingly simple card guidance with exact locating of the line to be printed.

In accordance with the present invention, a tube shaped card guide element is arranged on and surrounds a setting shaft. The guide element is spaced radially outwardly from the setting shaft and carries a line pattern part having sensible markings. A stop and rest part is positioned on the setting shaft and is radially adjustable under spring tension so that the stop and rest part slidingly rests on the internal surface of the card guide element for defining the line to be printed and the line pattern on the record carrier by cooperating with the markings on the card guide element.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
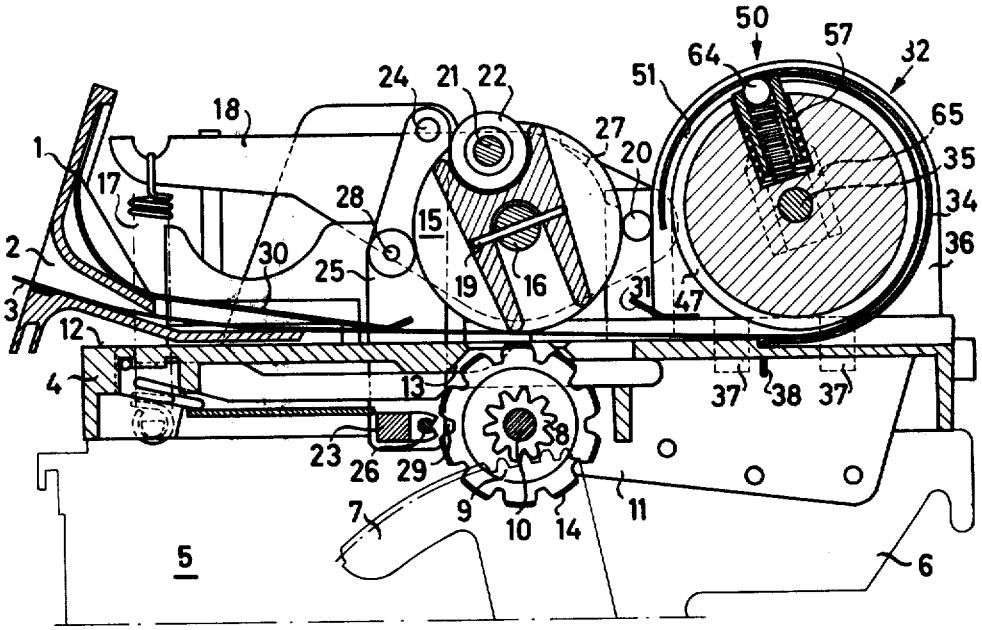
FIG. 1 is a lateral section through a device for setting the printing line in a printer which has an input slot arranged at its front side for the horizontal insertion of a card to be printed.

FIG. 1 shows a printing apparatus with a device for setting the printing line. Apart from the front wall 1 which has an input slot 2 through which a record carrier 3 is inserted, the housing parts surrounding the printing apparatus are not illustrated. The printing apparatus as shown in FIG. 1 is a unit mounted on a carrier plate 4 and is generally designed to be combined with a quantity counter unit 5 of which only the side wall 6 is shown. By means of the quantity counter unit 5, toothed segments 7 are adjusted to the value to be indicated thereby also setting printing type wheels 9 connected to toothed wheels 8. Depending on the desired capacity of the printing apparatus there are several type wheels 9 arranged on a common shaft 10 and subdivided into several groups, the shaft 10 itself being mounted in lateral walls 11 on the carrier plate 4. The upper plane 12 of the carrier plate 4 essentially serves as a support for the record carrier 3. The plate 4 is provided with a cut-out 13 adjacent the type wheels 9 so that the type wheels 9 can be turned for positioning each individual type character 14 in the plane of the surface 12. Normally above the type wheels 9, there is a printing support drum 15 fixed to a shaft 16 by means of a pin 19 and rotatably arranged on pivotally mounted lever arms 18 which are tensioned by springs 17. The lever arms 18, arranged on both sides of the printing support drum 15, are positioned on a shaft 20 mounted on the carrier plate 4. The printing is effected by printing rollers 22, rotatably mounted on a shaft 21 and located in the printing drum 15 for projecting above its periphery. When the printing drum 15 rotates the printing rollers 22—under the pressure of the springs 17—roll over the type wheels 9 arrested by a stop bar 23 as presented for printing. The stop bar is fastened to a lever arm 25 and is pivoted on bolts 24. It carries an adjusting shaft 26, which by means of a cam disk 27 and sensing rollers 28 can be moved into and out of engagement with the toothing 29 on the type wheels 9.

To effect printing, the record carrier 3 is inserted into the input slot 2 at the front of the apparatus and moved to a fixed stop (see FIG. 1). A forward printing station and the parts 9 and 15 serve as a guide for the record carrier 3 through the bottle-neck between the printing wheels 9 and the printing support 15. During insertion, a backward guide plate 31 behind the printing station 9, 15 forces the record carrier 3 to enter linearly into a tube shaped wound card guide element 32. Moreover, the backward guide plate 31 avoids any bending of the record carrier 3 at the moment it is arrested by a stop and rest part 33 defining the printing line and, respectively, its extent of motion.

Figure 3:
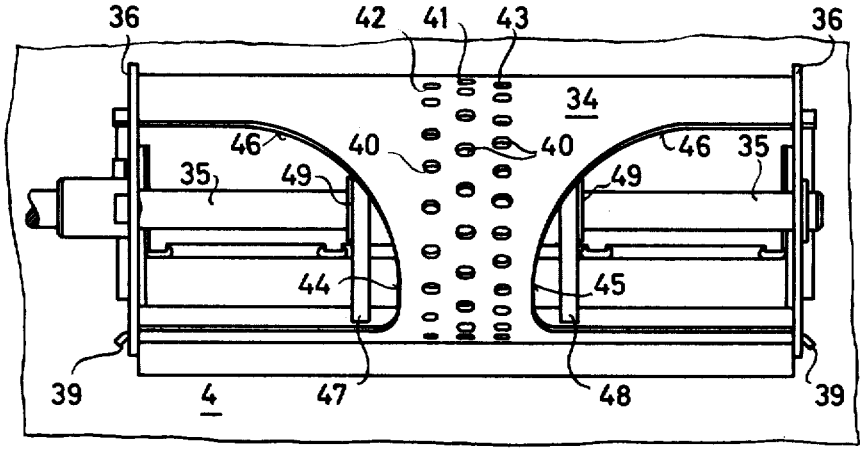
FIG. 3 is a top view of the card guide element with the line pattern for setting various line spaces.

As an external guidance for the card there is a tube shaped outward guide plate 34 wound at a certain radial distance round an adjusting shaft 35. The guide plate 34 is laterally held in side walls 36 to which it is fixed by means of distorted lugs 39, with the lateral walls 36 being connected by means of fixing lugs 37 to the carrier plate 4 in much the same manner as the guide plate 34 is connected by means of its lugs 38. Preferably, in the middle between the two side walls 36 and in the circumferential direction as for the guide plate 34, there are provided sensible markings 40 in the shape of a punched hole pattern 41. Of course, instead of the holes, embossed beads or the like could be provided as sensible markings. To be able to vary the distance of the lines and the number of lines on the surface to be printed in the input direction of the record carrier 3, the guide plate 34 is provided with several patterns 41, 42 and 43 of punched holes adjacent each other, the markings 40 in each pattern line being arranged at another angular distance to each other. At the guide plate 34 as a peripheral guide element, cut-outs 44 and 45 of increasing width with respect to the input direction of the record carrier 3, are provided to reduce the friction between the record carrier 3 and the internal guide surface 46 on the guide plate 34. To depress the record carrier 3 internally, there are card guide elements distributed on the adjusting shaft 35 defining the position of the record carrier especially as its winding angle increases. These are at least two rotatable guide rollers 47, 48 (FIGS. 1 and 3). The diameter of the guide rollers 47, 48 is such that between them and the external card guidance by the guide plate 34, there is a sufficient distance so that the record carrier 3 which frequently consists of several sheets may be easily pushed therethrough so that the tendency in the record carrier material to take up a straight form does not influence the line locating. The axial position of the guide rollers 47, 48 is defined by locking disks.

Figure 4:
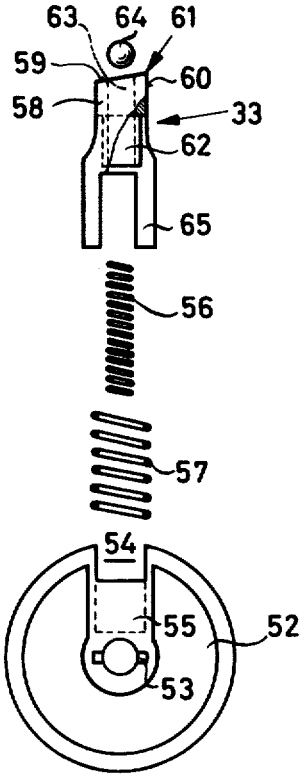
FIG. 4 is an exploded representation of the stop and rest parts.

The adjustable card stop and rest element consists of a stop part 33 fastened to the setting shaft 35 and spring actuated in radial direction, and of a rest part 50 of such a kind that the stop part 33 continuously rests on the internal surface 51 of the tube shaped card guide element 32. Independently thereof the rest part 50 defines the printing line and the distance of the lines between each other on the record carrier 3 by cooperating with the markings 40 at the card guide element 32. The rest part 50 is axially displaceable mounted on the setting shaft 35 so as to be in line with a certain line of punched hole patterns 41, 42 or 43. As a carrier and driving element for the stop and rest parts or elements 33, 50 there is a disk 52 connected to the setting shaft 35 by means of a simple pin and slot connection 53 (see FIG. 4). A U-shaped and axially extending recess 54 on the disk 52 and a bore 55 extending radially as an extension of the recess 54, serve to take up the stop element 33 and two pressure springs 56 and 57. The stop element 33 itself consists of a slide 58 radially movably mounted in the recess 54. The slide slopes in the input direction of the record carrier 3 at its peripheral front side 59 so that, at the card supporting surface 60, a stop edge 61 is formed which slides over the internal surface 51 of the guide plate 34. At the slide 58 there is a vertically inwardly arranged projection 62 with an internal bore 63 which serves to take up a ball 64 as the rest part and the pressure spring 56 cooperate therewith. The external surface of the projection 62 coaxially thereto, supports the second pressure spring 57 independently thereof for the radial movement of the stop element 33. At both ends, the slide 58 of the stop element 33 is provided with fork-shaped arms 65 extending in the direction towards the setting shaft 35 to fix the slide 58 on the setting shaft 35 and to guide the stop element 33. Via the double sided guidance of the stop element 33 within the recess 54 and on the setting shaft 35, a slanting of the slide 58 in its frictional contact with the guide plate 34 is made impossible. When mounted, the ball 64 under the pressure of the spring 56 continuously lies against the internal surface 51 of the guide plate 34 and rests in the holes of the correspondingly chosen patterns 41, 42 or 43 in the right angular position.

Figure 2:
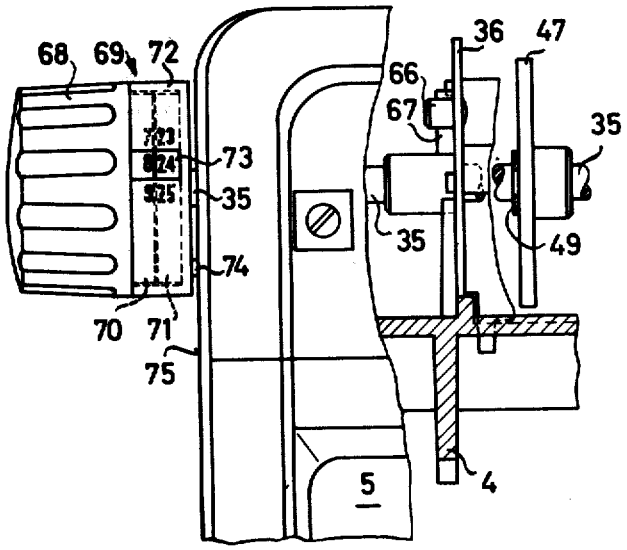
FIG. 2 is a partial view of a manual setting means for locating the line stop with visible indicating means to mark the printing line set.

To limit the adjustable printing range of a record carrier 3 and to avoid an overturning in the two directions, in accordance with the embodiment of FIG. 2 at one side wall 36, there is a bolt 66 which in the two directions of rotation serves as a stop for a lever arm 67 fastened on the setting shaft 35 thereby defining the end position of a possible line selection.

For preselecting the line to be printed in the embodiment according to FIG. 2, a manually rotatable knob 68 is provided which is fastened to the setting shaft 35. The rotatable knob 68 is provided with a scale 69 representing the line to be printed as adjusted in accordance with the stop and rest element 33, 50. The scale 69 can be subdivided into several columns 70, 71 so that when there are several punched hole patterns 41, 42, 43, a corresponding column of symbols can be indicated at the scale 69. In the embodiment according to FIG. 2 the scale 69 shown, for instance, is a subdivision of a month in two halves for the line ranges for the days 1 to 16 and 17 to 31.

In order to achieve a verified reading of the printing line, the setting shaft 35 is provided with an unrotatable bushing 72 of line width. The bushing 72 covers the scale 69 and by means of the window 73 permits viewing of the line to which the printer is adjusted. The bushing 72 is unrotatably mounted by means of a pin 74 which engages into a bore in the housing wall 75.

The special advantage of the device for predetermining the printing line in a printer for record carriers to be inserted, is seen in the design of the record carrier guidance and in the simple and compact shape of the adjustable stop and rest element. The principle of a tube shaped guide part for the record carrier in the card stop range takes up very little space for the rather large range of lines to be printed, that is for use with relatively long insertable record carriers. The record carrier guiding means which is, so to say, wound up, consists of very simple parts, namely of the tube shaped external guide plate and the concentrically arranged guide rollers movable on a concentric shaft. The same shaft is simultaneously the setting shaft and unrotatably but axially displaceable thereto the stop and rest elements. At the same time, the record carrier stop element is a guiding part for an elastically mounted ball which rests in a punched hole pattern within the guide plate to define the printing lines. Corresponding to the position of the stop element for adjusting the printing line, the setting shaft is also unrotatably connected to a scale arranged on the circumference of a rotatable knob as an adjusting means with the scale having symbols clearly attributed to each printing line. Since there is a bushing covering the setting shaft with a cut-out of line width, only the symbol for the actually adjusted printing line may be read while the other parts of the scale range are covered. Therefore, the adjustment of the desired line is greatly facilitated and it is always possible to see which line has been set up.

What is claimed is:

1. In a device for determining a line to be printed on a record carrier in a printer in which the record carrier can be inserted by an adjustable amount, including a stop member, setting means for adjusting said stop member within a printing range of at least 16 lines and comprising an axially extending setting shaft, a tube shaped card guide element extending arcuately around the axis of said setting shaft and spaced radially outwardly from said setting shaft, said card guide element having an internal surface including a pattern of engageable depressions corresponding to the individual lines of said printing range extending in the direction around the axis of said setting shaft, and said stop member comprising a stop and rest part positioned on said setting shaft and extending radially outwardly toward the internal surface of said guide element and spring means for radially outwardly urging said stop and rest part under spring tension so that the stop and rest part slidingly rests in a depression of said pattern on the internal surface of said tube shaped card guide element and engages with one said depression thereon, for defining the extent of the insertion of the carrier to thereby define the line to be printed.

2. Device according to claim 1, wherein said card guide element includes an external circularly wound up guide plate open in the input direction of the record carrier and arranged generally concentrically relative to said setting shaft.

3. Device according to claim 2, wherein the pattern of engageable depressions are located in said external guide plate.

4. Device according to claim 3, wherein said pattern of engageable depressions corresponding to the individual lines of said printing range extend in the circumferential direction of said setting shaft with punched hole patterns defining the different line steps and different numbers of lines.

5. Device according to claim 2, wherein said external guide plate having cut-outs of increasing width in the input direction of the record carrier for reducing the friction between the record carrier and the internal surface of said guide-plate.

6. Device according to claim 4, wherein said stop and rest part having a rest element axially displaceably arranged on said setting shaft and alignable with the selected punched hole pattern.

7. Device according to claim 1, wherein said stop and rest part comprises a disk fastened on the said setting shaft and said disk having a U-shaped recess extending radially of said setting shaft and a radially extending projection containing a bore and said spring means comprises a pressure spring in the bore for influencing said stop and rest part.

8. Device according to claim 7, wherein said stop and rest part includes a stop element and a rest element comprising a slide mounted for radial movement in said recess and said slide having a sloping edge in the input direction of the record carrier forming a stop edge at the surface which slides over the internal surface of said guide element.

9. Device according to claim 8, wherein said slide including a tube shaped projection having an internal bore, said rest element comprises a ball receivable in the internal bore, a first pressure spring biasing said bore, a second pressure spring being independently effective and the external surface of said tube shaped projection serving to guide said second pressure spring for keeping said stop part in frictional engagement.

10. Device according to claim 8, wherein a fork shaped arm located at each of the two sides of said slide of said stop part and turned in the direction toward said setting shaft so that said stop part is mounted on the setting shaft and guided thereon.

11. Device according to claim 1, including side walls for holding said guide element, a fixed bolt in one said side wall, a lever arm on said setting shaft cooperating with said fixed bolt which serves as a limitation to said setting shaft in both setting directions to avoid overturning.

12. Device according to claim 1, wherein a rotatable knob is connected to said setting shaft and is provided with a scale to indicate the printing line set up.

13. Device according to claim 12, wherein a stationary bushing is arranged over said setting shaft and has a window of line width covering the scale so that through the window corresponding line marking is visible.

* * * * *